US011505291B2

(12) United States Patent
Oryniak

(10) Patent No.: US 11,505,291 B2
(45) Date of Patent: Nov. 22, 2022

(54) MODULAR FLOATING VESSEL

(71) Applicant: Bogdan Oryniak, West Bloomfield, MI (US)

(72) Inventor: Bogdan Oryniak, West Bloomfield, MI (US)

( * ) Notice: Subject to any disclaimer, the term of this patent is extended or adjusted under 35 U.S.C. 154(b) by 44 days.

(21) Appl. No.: 17/124,274

(22) Filed: Dec. 16, 2020

(65) Prior Publication Data

US 2021/0188404 A1 Jun. 24, 2021

Related U.S. Application Data

(60) Provisional application No. 62/950,478, filed on Dec. 19, 2019.

(51) Int. Cl.

| | |
|---|---|
| ***B63B 35/38*** | (2006.01) |
| ***B63B 3/48*** | (2006.01) |
| ***B63B 7/00*** | (2020.01) |
| ***B63H 21/17*** | (2006.01) |
| ***B63B 29/04*** | (2006.01) |
| ***B63B 7/02*** | (2020.01) |
| ***B63H 16/04*** | (2006.01) |
| ***B63B 45/00*** | (2006.01) |
| ***B63B 1/12*** | (2006.01) |
| ***B63B 5/02*** | (2006.01) |

(52) U.S. Cl.

CPC ..... *B63B 35/38* (2013.01); *B63B 1/121* (2013.01); *B63B 3/48* (2013.01); *B63B 5/02* (2013.01); *B63B 7/00* (2013.01); *B63B 7/02* (2013.01); *B63B 29/04* (2013.01); *B63B 45/00* (2013.01); *B63H 16/04* (2013.01); *B63H 21/17* (2013.01); *B63B 2029/043* (2013.01)

(58) Field of Classification Search

CPC ..... B63B 35/38; B63B 1/125

See application file for complete search history.

(56) References Cited

U.S. PATENT DOCUMENTS

| | | | | |
|---|---|---|---|---|
| 3,795,926 | A | 3/1974 | Hoshino | |
| 4,706,597 | A * | 11/1987 | Figone | B29C 53/06 114/352 |
| 5,237,954 | A | 8/1993 | Evans | |
| 5,349,918 | A * | 9/1994 | Elie | B63B 7/04 114/61.24 |
| 7,963,243 | B2 | 6/2011 | Quigley | |
| 9,481,219 | B2 * | 11/2016 | Dovel | B60F 3/0069 |
| 9,738,129 | B2 * | 8/2017 | Dovel | B63H 16/12 |
| 10,085,566 | B1 * | 10/2018 | Gallant | B60N 2/22 |
| 10,155,579 | B2 * | 12/2018 | Marchio | G05D 1/0206 |
| 2007/0295255 | A1 * | 12/2007 | Stryjewski | B63B 35/34 114/352 |
| 2016/0059945 | A1 * | 3/2016 | Arad | B63B 1/121 440/23 |
| 2021/0107605 | A1 * | 4/2021 | Enyart | B63B 1/125 |

FOREIGN PATENT DOCUMENTS

| | | | | |
|---|---|---|---|---|
| CN | 206813261 | U | 12/2017 | |
| EP | 3725666 | A1 * | 10/2020 | B63B 1/125 |

* cited by examiner

*Primary Examiner* — S. Joseph Morano
*Assistant Examiner* — Jovon E Hayes
(74) *Attorney, Agent, or Firm* — The Dobrusin Law Firm, P.C.; Bryan S. Lemanski

(57) ABSTRACT

A floating vessel comprising: (a) opposing hulls; (b) a beam extending between and interconnecting the opposing hulls; and (c) a deck supported by the beam and positioned between the opposing hulls, wherein the floating vessel is modular and configured for easy assembly, disassembly, or both.

20 Claims, 5 Drawing Sheets

MODULAR FLOATING VESSEL

FIELD

The present teachings generally relate to a vessel, and more particularly, to a modular floating vessel configured for easy transportation and assembly.

BACKGROUND

Floating vessels, such as fishing boats, pontoon boats, sailboats, and other types of floating vessels are frequently used in a variety of industries. For example, fishing boats may range in scale for both commercial fishing and leisure fishing activities. Frequently, boats will include a deck substantially disposed over a buoyant hull. The deck and the hull will often be constructed as separate components and then later substantially homogenously joined in a seamless manner. Therefore, the resultant vessel may often be free of any visible seams or joints.

However, as a result of conventional manufacturing processes, it is often difficult and/or costly to repair boats. For example, if a portion of the hull is damaged and needs repair, an operator may generally need to cut out the damages portion and patch the area. Alternatively, an entire hull may be replaced by complete disconnection and reassembly. In either case (and in most conventional repair methods), the boat will frequently have at least one point of weakness in the structure after repair due to the newly added joints or patches.

In addition to the difficulties repairing most boats, transportation and storage of the vessels may require extensive preparation and space. For example, most boats are not collapsible and require storage space substantially equal to or greater than an area of the boat. Additionally, most boats may often require a specific trailer to tow the boat from one desired location to another, thereby resulting in even further cost being incurred.

Thus, it would be attractive to have an easily repaired boat that minimizes points of weakness from joints or patchwork. What is needed is a floating vessel made from modular components that can be easily replaced if damaged. It would be attractive to have a vessel that is easily transportable, requires minimal storage space, or both. What is needed is a collapsible vessel that can easily be assembled and disassembled for use, storage, or both.

SUMMARY

The present teachings meet one or more of the present needs by providing: a floating vessel comprising: (a) opposing hulls; (b) a beam extending between and interconnecting the opposing hulls; and (c) a deck supported by the beam and positioned between the opposing hulls, wherein the floating vessel is modular and configured for easy assembly, disassembly, or both.

The present teachings meet one or more of the present needs by providing a floating vessel, wherein: the deck includes a channel and the beam extends through the channel to support the deck; the vessel further comprises a plank positioned between the deck and the opposing hulls, wherein the plank is supported by the beam and forms additional decking of the vessel; the vessel further comprises a panel extending between the opposing hulls and secured in grooves of the opposing hulls to form a back of the vessel; the panel is at least partially supported by the opposing hulls, the deck, or both; the vessel includes a plurality of beams and a portion of the plurality of beams forms oars that are movably secured to the vessel; the opposing hulls, the deck, or both include a compartment configured to house a battery; the battery is configured to power a motor of the vessel, to power lights positioned along the vessel, or both; the deck includes a mount to secure a removable seat of the vessel; the beam extends through a fitting mounted to the opposing hulls and is received by a hole of the opposing hulls; the fitting is substantially coaxial with the hole; the fitting secures the beam in place via a fastener; a ledge of the opposing hulls, the deck, and the plank are substantially coplanar, and a surface of the ledge, a surface of the deck, and a surface of the plank form a substantially planar walkway; the floating vessel is configured for repetitive assembly and disassembly free of any damage to the floating vessel; the opposing hulls are formed from interconnected structural members and the structural members form a cavity within the opposing hulls; the cavity is filled with an insulating material; the structural members are covered in a reinforcing material; the structural members are wood, and the reinforcing material is fiberglass; the floating vessel is entirely battery operated and is free of any fuel consumption; the floating vessel is a boat; or a combination thereof.

The present teachings meet one or more of the present needs by providing: an easily repaired boat that minimizes points of weakness from joints or patchwork; a floating vessel made from modular components that can be easily replaced if damaged; a vessel that is easily transportable, requires minimal storage space, or both; a collapsible vessel that can easily be assembled and disassembled for use, storage, or both; or a combination thereof.

DETAILED DESCRIPTION

Figure 1:
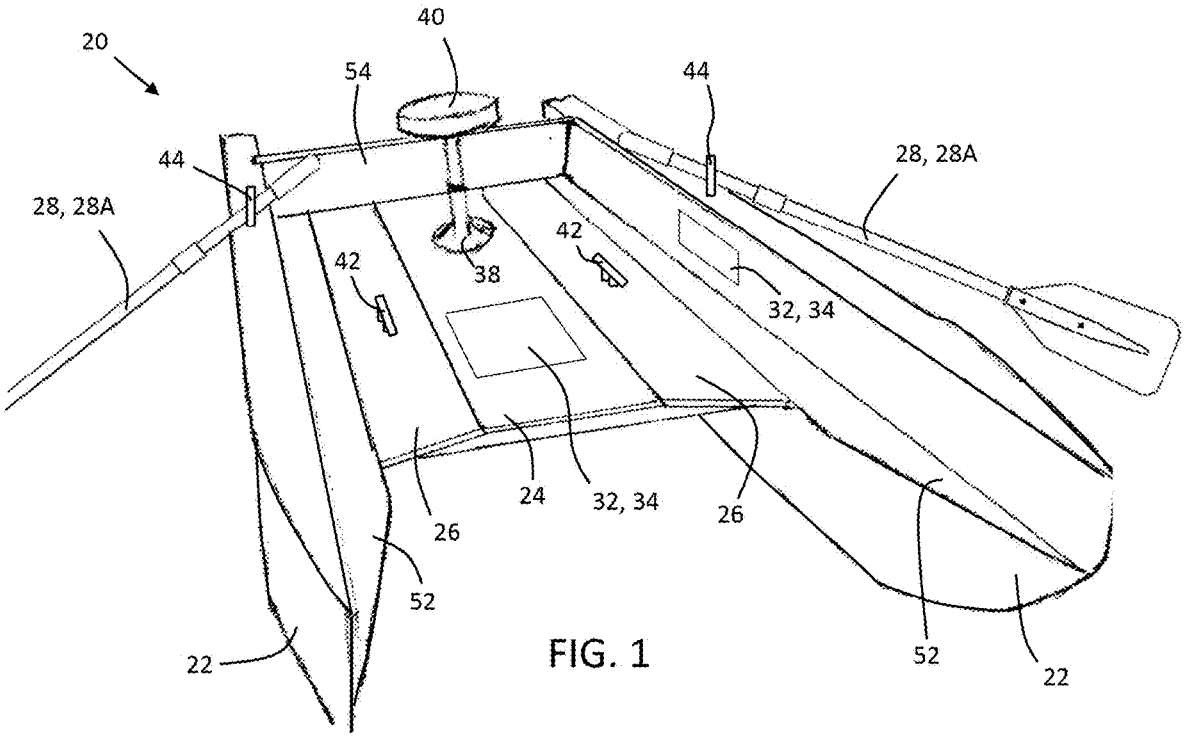
FIG. 1 is a front perspective view of a modular vessel.

The explanations and illustrations presented herein are intended to acquaint others skilled in the art with the invention, its principles, and its practical application. Those skilled in the art may adapt and apply the teachings in its numerous forms, as may be best suited to the requirements of a particular use. Accordingly, the specific embodiments of the present teachings as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings relate to a vessel. The vessel may function as a buoyant transportation device for use in water. The vessel may be any floating vessel, such as a fishing boat, catamaran, pontoon boat, offshore racing boat, sailboat, other type of boat, or a combination thereof. It is contemplated that teachings herein may be implemented over a variety of boat types, sizes, and shapes. As such, it is envisioned that the vessel may be highly customizable, tunable, and modular. Accordingly, the vessel is easily disassembled, assembled, or both. The disassembly, assembly, or both may be facilitated by quickly connected and/or disconnected components of the vessel. For example, each component may include a quick-connect fastener or attachment mechanism so that modular components of the vessel may be efficiently put together. The modular components may include, but are not limited to: a hull, deck, plank, beams, oars, seats, motor, or a combination thereof.

The vessel may be more easily transported and/or stored when compared to a conventional floating vessel. For example, the vessel may be disassembled for storage and transportation so that the components of the boat in aggregate take up substantially less space than the vessel fully assembled. The vessel disassembled may require about 90% or less, about 80% or less, or about 50% or less space for storage and/or transportation when compared to the vessel fully assembled. The vessel disassembled may require about 20% or more, about 30% or more, or about 40% or more space for storage and/or transportation when compared to the vessel fully assembled. Therefore, it is envisioned that the vessel disclosed herein may decrease the cost of storage and transportation. For example, an owner of the vessel may no longer require an offsite storage facility or dedicated storage location that is often required for a conventional boat. Furthermore, the vessel may also be transported using a typical automobile such as a sedan or sports utility vehicle (SUV) without the need of a trailer. For example, the vessel may be transported from a first location to a second location in a disassembled state using a conventional vehicle and assembled at the second location for operation, thereby eliminating the need of transporting the vessel in a fully assembled state. Additionally, due to the modularity of the vehicle, the vessel may include a plurality of components that are easily replaceable. As such, if the vessel is damaged (such as during operation), a damaged component may be quickly replaced without requiring extensive repairs, time, cost, or a combination thereof. Furthermore, because modular components may be quickly replaced without patchwork or additional connections, the vessel may be free of additional weak points inherent in conventional boat repair methods.

The vessel may include a hull. The hull may function to provide a buoyant contact between the vessel and a body of water. The hull may be structured in any desired size and/or shape. The hull may be positioned anywhere along the vessel. However, it is contemplated that the hull may act as an intermediary between the deck or other components of the vessel and the body of water. The hull may be monolithically (i.e. integrally) formed. The hull may at least partially support a deck of the vessel, a plank of the vessel, or both. The hull may at least partially form an outer perimeter of the vessel. For example, the vessel may include opposing hulls positioned near opposing sides of the vessel so that a span between the hulls is substantially equal to a width of the vessel. The hull may form a wall of an interior compartment of the vessel. For example, an assembled vessel may include a cockpit for a user to operate the vessel, and the cockpit may at least partially be surrounded by a portion of the hull.

The hull may include a ledge that may function to support a portion of the vessel, such as one or more panels. The ledge may at least partially form a walkway or floor of the vessel. The ledge may extend from the hull to be substantially parallel to a deck of vessel, planks of the vessel, or both. The ledge, along with the deck, the planks, or both, may form a substantially planar surface for an operator of the vessel. The ledge may abut the panels, planks, deck, or a combination thereof. For example, a terminal edge of the ledge may abut the planks, the deck, or both. The ledge may be connected to the deck, planks, panel, or a combination thereof. Alternatively, the deck, planks, panel, or a combination thereof may only abut the ledge and be free of connection to the ledge.

The vessel may include a deck that may function to support a user of the vessel, one or more items being transported within the vessel, or both. The deck may support additional components of the vessel, such as a panel, a seat, a motor, other components, or a combination thereof. The deck may at least partially create a walkway of the vessel. The deck may at least partially form a cockpit of the vessel. The deck may be positioned above the hull, between hulls, or both. The deck may be formed of a unitary panel or may comprise a plurality of interconnected planks. It is contemplated that the deck may be directly or indirectly supported by the hull. For example, the deck may be supported by a portion of the hull (e.g., a ledge of the hull) or may be connected to the hull via a beam. It may be desired that the deck is free of submersion within a body of water during operation. For example, the deck may remain substantially above the water during operation while the hull is at least partially submerged to support the vessel. It is envisioned that the deck may be any desired size and shape.

The vessel may include at least one channel configured to receive a portion of a beam. The channel may extend through a thickness (e.g., measured between opposing exterior surfaces of the deck). For example, a beam may extend through the channel to at least partially support the deck. The beam may extend through the entire width of the deck so that opposing ends of the beam are secured to opposing hulls of the vessel. As such, it is envisioned that the channels may substantially align with holes of the vessel so that the beam may extend through the deck and into the hull. The channel may be any shape. It is contemplated that the channel is sized substantially equal to or greater than a cross-section of the beam so that the beam may be inserted into the channel. The channels may include an opening on any surface of the deck. The surface of the deck that includes an opening of the channel may be a surface substantially perpendicular to a walking surface of the deck (i.e., a side surface). The channel may be threaded, may be free of threading, may include a lubricant, or a combination thereof. The channel may be tapered or may be substantially uniform.

The vessel may also include one or more planks. The planks may provide additional walking space of the vessel. The planks may at least partially form a cockpit of the vessel. The planks may rest along a beam of the vessel. The planks may interconnect the deck to a hull of the vessel. For example, the planks may be an intermediate portion between the deck and the hull so that the deck, planks, and hull form a substantially coplanar surface for a user to walk along. As such, the planks may be connected to the hull, deck, or both via fasteners. The fasteners may be a screw, bolt, pin, latch, clasp, hook, finger, or a combination thereof. Alternatively, the planks may include a hole, channel, receiving feature, or a combination thereof that mates with a portion of the deck, hull, or both. It is contemplated that the planks may be removed and/or attached to the vessel after assembly of the remaining components.

As illustrated above, at least one beam of the vessel may interconnect components of the vessel, may support a portion of the vessel, or both. The beam may be structurally rigid to support a weight of the modular components (e.g., the planks, deck, hull, etc.), a user of the vessel, or both. The beam may also be sufficiently strong to prevent distortion or permanent damage during operation of the vehicle due to stress from the body of water the vessel is traveling through. Any number of beams may be used for assembly of the vessel. The beam may act as a crossmember between hulls. The beam may have any desired cross-section, length, or both. The beam may include an attachment mechanism to secure the beam to other components of the vessel. For example, the beam may be inserted into a fitting on the hull and secured with a fastener extending through the fitting and into a portion of the beam. As such, it is envisioned that the beams may be secured to other components in a removable fashion so that the beams may be connected and disconnected from other components without damage to any portion of the vessel. Additionally, the beam may provide further customization to the vessel. For example, a portion of beams may interconnect components of the vessel to assemble the vessel while additional beams may at least partially form oars of the vessel. Therefore, the beams may allow for commonality between components utilized for different applications within the vessel, such as accessories, structural support, or both. The commonality may allow the vessel to be manufactured with substantial cost-savings, decreased manufacturing time, or both when compared to a conventional boat. For example, because the beam may be a common structure with the oar, a cost for tooling separate components for the beam and oar may be eliminated.

The vessel may also include a panel that may form a sidewall of an inner compartment of the vessel. The panel may function to align and/or interconnect portions of the vessel, such as opposing hulls of the vessel. The panel may be received by a groove or fitting of the hull, deck, planks, or a combination thereof. The panel, once connected and assembled to the vessel, may form a substantially waterproof inner compartment. As such, the outer periphery of the vessel may substantially prevent water from entering the inner compartment formed by the deck and/or planks.

It is envisioned that the vessel may also include one or more accessories to provide even further customization of the vessel. The accessories may include an oar, seat, cleat, oar lock, or a combination thereof. For example, the oar may be at least partially formed by a beam of the vessel and may be secured within an oar lock located on a wall of the hull. The accessories may be mounted to any modular component of the vessel, such as the hull, deck, plank, panel, or a combination thereof. The accessories may be removably attached to the modular components or may be integrally formed with the modular components. The components may also include a plurality of mounting locations to further customize assembly of the vessel. For example, the seat may be mounted to the deck via a mount. However, the deck and/or planks may include a plurality of mounts so that the seat may be positioned in a variety of locations. Additionally, the plurality of mounts may facilitate the addition of secondary seats for more than one user of the vessel.

The vessel may also include at least one compartment for housing one or more items. The compartment may be located on the hull, deck, panel, plank, or a combination thereof. The compartment may be a plurality of compartments. For example, the hull and the deck may each include a compartment. The compartment may be any size and shape. The compartment may be substantially waterproof or even hermetically sealed. The compartment may be accessible. For example, the compartment may include a door or access panel to remove and insert items.

The compartment may function as a housing of one or more batteries. The battery may function to power a portion of the vessel. The battery may be any type of battery that may provide sufficient power to the vessel. The battery may power lights on the vessel, secondary accessories (e.g., a monitor located on the vessel), or both. The battery may provide sufficient power to power a motor located on the vessel. For example, a primary battery may be located in a compartment of the deck and may be configured to power a motor of the vessel. Secondary batteries may be located in compartments of the hull to power lights of the vessel or other secondary accessories.

It is further envisioned that the vessel may be manufactured from conventional materials. For example, a shape of the hull may be formed of a plurality of interconnected structural members. The structural members may be secured to another to provide strength to the hull and form a footprint of the hull. The structural members may be a conventional water-treated wood, plastic, other material, or a combination thereof.

The structural members may create one or more cavities. The cavities may form a channel or hole to receive a component (e.g., a beam) of the vessel. Alternatively, the cavity may be filled with an insulating material to insulate the vessel. For example, the insulating material may be a foaming material that substantially fills the cavity and prevents water from penetrating an interior of the hull, thereby substantially preventing degradation of the hull. The insulating material may be any material configured for insulation of a cavity.

An exterior portion of the vessel, such as the hull, may be covered in a reinforcing material. The reinforcing material may function to not only structurally reinforce the vessel but may also form an outer contour of the vessel. The reinforcing material may be waterproof and may contact or even be submerged in the body of water during operation of the vessel. The reinforcing material may be fiberglass or a similar material. The reinforcing material may be adhered to the structural members, insulating material, or both. The reinforcing material may be laminated along the structural members, insulating material, or both. The reinforcing material may be disposed on any portion of the vessel. For example, the reinforcing material may be locally applied to the vessel to reinforce only desired points of weakness of the vessel to minimize manufacturing costs of the vessel.

Turning now to the figures, FIGS. 1A and 1B illustrate a front and rear perspective view, respectively, of a modular vessel 20. The vessel 20 includes a deck 24 connected to opposing hulls 22. The deck 24 is connected to the hulls 22 by a plurality of beams that extend between the hulls 22 and support the deck 24 (see FIG. 3). Each hull 22 and/or the deck 24 may include a compartment 32. It is contemplated that the compartments 32 may be configured to store one or more batteries 34. However, the compartments 32 may also store any other desired items. The batteries 34 may be connected to an accessory attached to the vessel 20, a motor mounted to the vessel 20, or both (not shown). For example, the batteries 34 stored in the hulls 22 may be electrically connected to headlights, taillights, or both positioned along the hulls 22 while a battery 34 stored within the deck 24 may be electrically connected to a motor of the vessel 22. The deck 24 may further include a seat 40 secured within a mount 38 of the deck 24. A pair of planks 26 may be disposed along the beams in between the hulls 22 and the deck 24 to provide additional decking area to the vessel 20. The planks 26 may include a cleat 42 to secure the vessel to one or more additional items (e.g., a dock). Additionally, a panel 54 may extend between grooves of the hulls 22 to provide a backing to the vessel 20. As illustrated, the panel 54 may be supported by ledges 52 of the hulls 22, the planks 26, the deck 24, or a combination thereof. It should be noted that the ledges 52, the planks 26, and the deck 24 may be substantially coplanar to provide a substantially flat surface for an operator of the vessel 20. However, the ledges 52, the planks 26, the deck 24, or a combination thereof may also be noncoplanar if desired. The vessel may further include a pair of oars 28A movably secured to the vessel 20 via oar locks 44 positioned on the hulls 22. As shown, the oars 28A may be formed using additional beams 28 of the vessel 20, further illustrating the modularity of the vessel 20. As such, it is envisioned that the modularity of the vessel 20 may accommodate easy assembly and disassembly so that an operator of the vessel 20 may store and/or transport the vessel 20 in a compact disassembled state. Therefore, an operator may not be required to transport the vessel 20 in a fully assembled state using a flatbed, a trailer, a larger vehicle, or a combination thereof. Additionally, the vessel 20 may require substantially less storage space when in the disassembled state.

Figure 2:
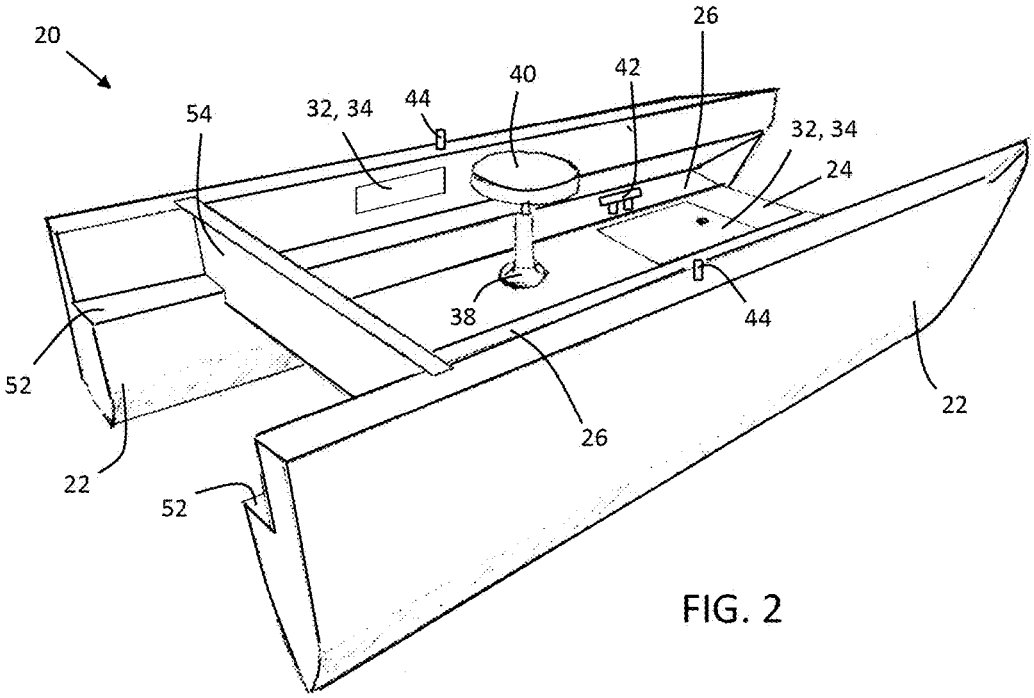
FIG. 2 is a rear perspective view of a modular vessel.
Figure 3:
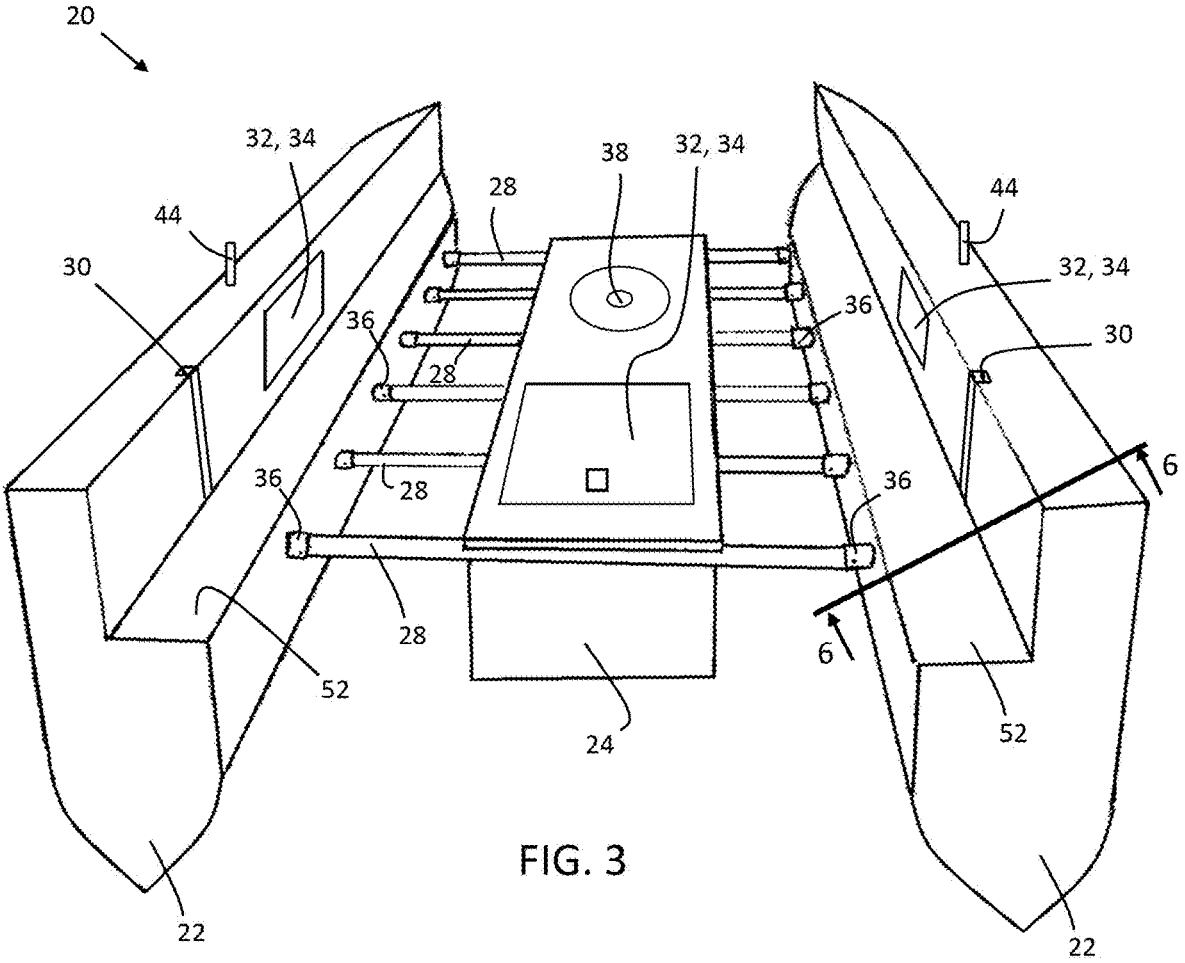
FIG. 3 is a rear view of a partial modular vessel.

FIG. 3 illustrates a rear view of a modular vessel 20 with the planks and back panel removed (see FIGS. 1 and 2). The vessel 20 includes a deck 24 connected to opposing hulls 22 by a plurality of beams 28. The beams 28 may extend through channels of the deck 24, may extend under a portion of the deck 24 to support an underside of the deck 24, or both. The beams 28 may extend between fittings 36 located on the opposing hulls 22 to secure the beams 28 within the fittings 36. It should be noted that the beams 28 may be secured within the fittings 36 in any fashion, such as with fasteners, adhesives, or both. Each hull 22 and the deck 24 may include a compartment 32 configured to store one or more batteries 34, one or more items, or both. The deck 24 may further include a mount 38 to secure a seat to the deck (see FIGS. 1 and 2). The back panel of the vessel 20 may be secured within grooves 30 of the hulls 22 to provide a backing of the vessel 20 (see FIGS. 1 and 2). The panel may also be supported by ledges 52 of the hull 22. Additionally, the hulls 22 may further include oar locks 44 to secure oars to the vessel 20.

Figure 4:
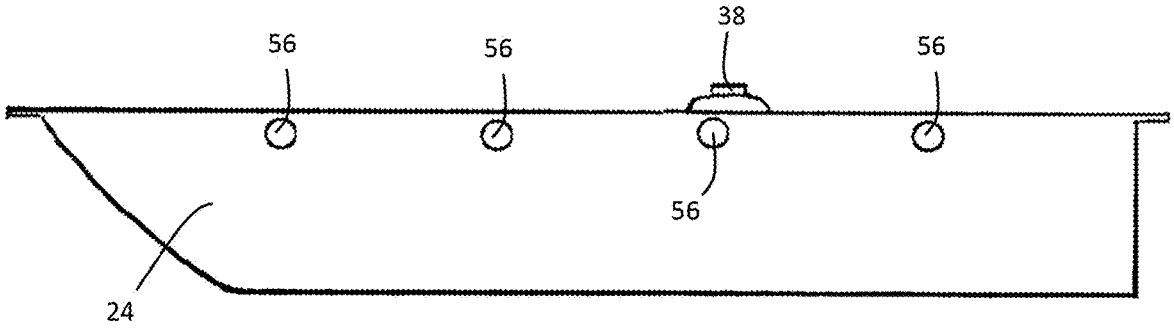
FIG. 4 is a side view of a deck of a modular vessel.

FIG. 4 illustrates a side view of a deck 24 of a vessel 20. The deck includes a plurality of channels 56. The channels 56 may extend through an entire thickness of the deck 24 (e.g., a width of the deck 24 measured substantially parallel to a beam of the vessel once assembled), through only a portion of the thickness of the deck 24, or both. For example, beams of the vessel 20 may extend through a channel spanning an entire thickness of the deck 24 so that opposing ends of the beams may be secured to opposing hulls of the vessel 20. Additionally, the deck 24 may include a mount 38 to secure a seat to the vessel 20.

Figure 5:
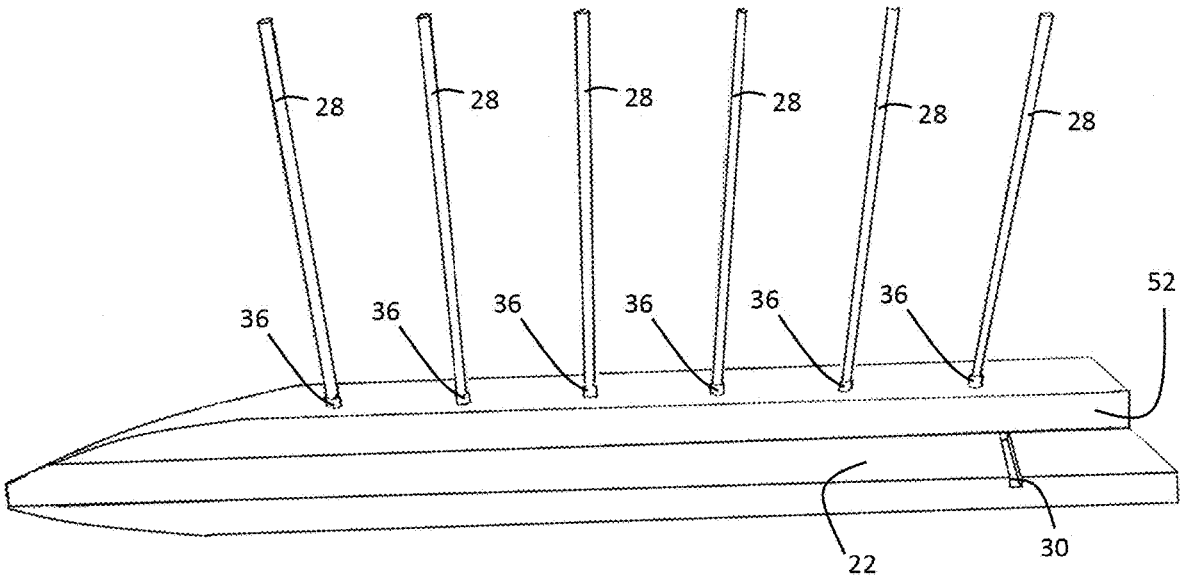
FIG. 5 is a perspective view of a plurality of beams secured to a hull of a modular vessel.

FIG. 5 illustrates a perspective view of a plurality of beams 28 secured to a hull 22 of a vessel. Each beam 28 extends into a fitting 36 and is secured within a hole of the hull 22. The fittings 36 may be substantially aligned with the holes of the hull 22 so that the fittings 36 guide the beams 28 into the holes. The fittings 36 may also secure the beams 28 using a fastener, adhesive, or both. The hull 22 may further include a groove 30 configured to receive a portion of a panel of the vessel (see FIGS. 1 and 2). Additionally, the hull 22 may include a ledge 52 configured to substantially align with a deck of the vessel, planks of the vessel, or both.

Figure 6:
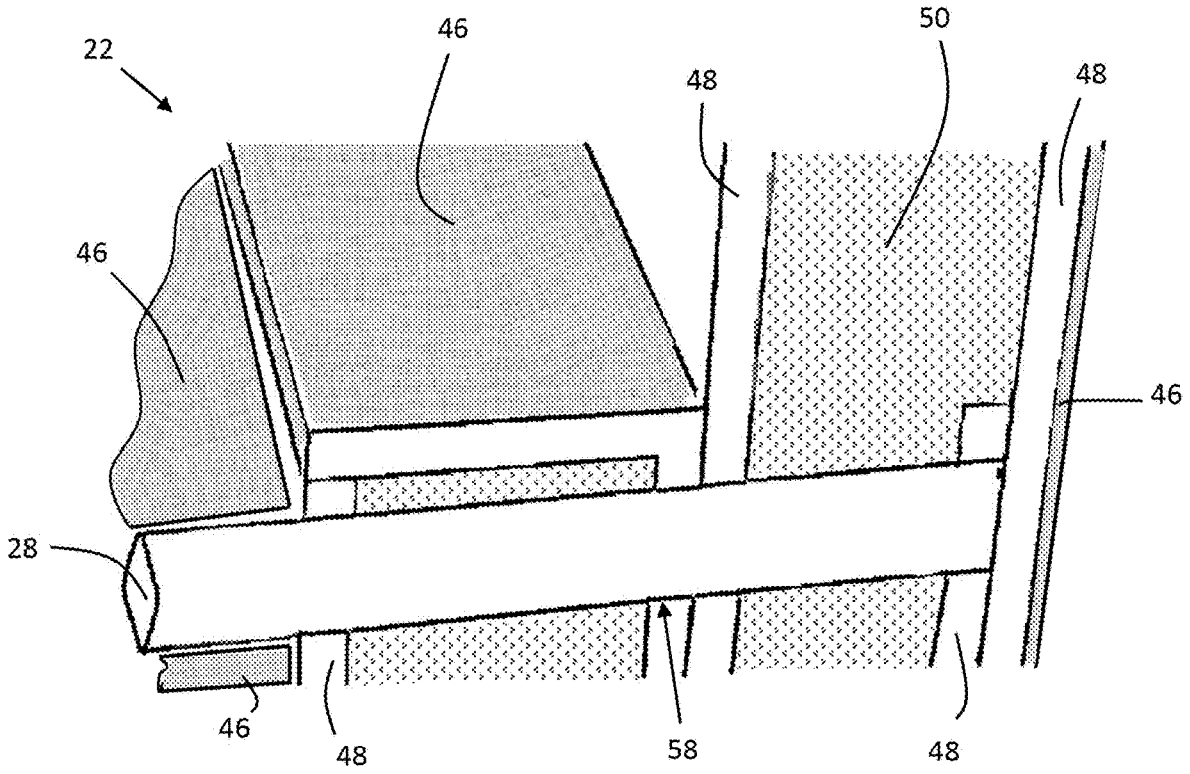
FIG. 6 is cross-section 6-6 of FIG. 3.

FIG. 6 illustrates cross-section 6-6 of the hull 22 of the vessel of FIG. 3. As illustrated, the hull 22 comprises a plurality of interconnected structural members 48 that substantially form a shape of the hull 22. The structural members 48 may be secured to one another by fasteners, adhesives, or both. The structural members 48 may form cavities within the hull 22 that may be filled with an insulating material 50. The insulating material 50 may further increase structural integrity of the hull 22, provide sound and/or vibration attenuation, or both. An exterior of the hull 22 may be covered in a reinforcing material 46 to further improve structural integrity of the hull 22. It should be noted that the reinforcing material 46, the structural members 48, the insulating material 50, or a combination thereof may exhibit water-repellant and/or water-resistant properties to prevent water from entering the hull 22 and causing degradation to the hull 22. Thus, it is contemplated that the reinforcing material 46, the structural members 48, and the insulating materials 50 may be any desired materials. For example, the structural members 48 may be wood panels that form cavities filled with a foaming insulating material 50, and the hull 22 structure formed by the structural members 48 may be covered in fiberglass as the reinforcing material 46. As shown, a beam 28 of the vessel may extend into a hole 58 formed within the vessel to interconnect components of the vessel.

Figure 7A:
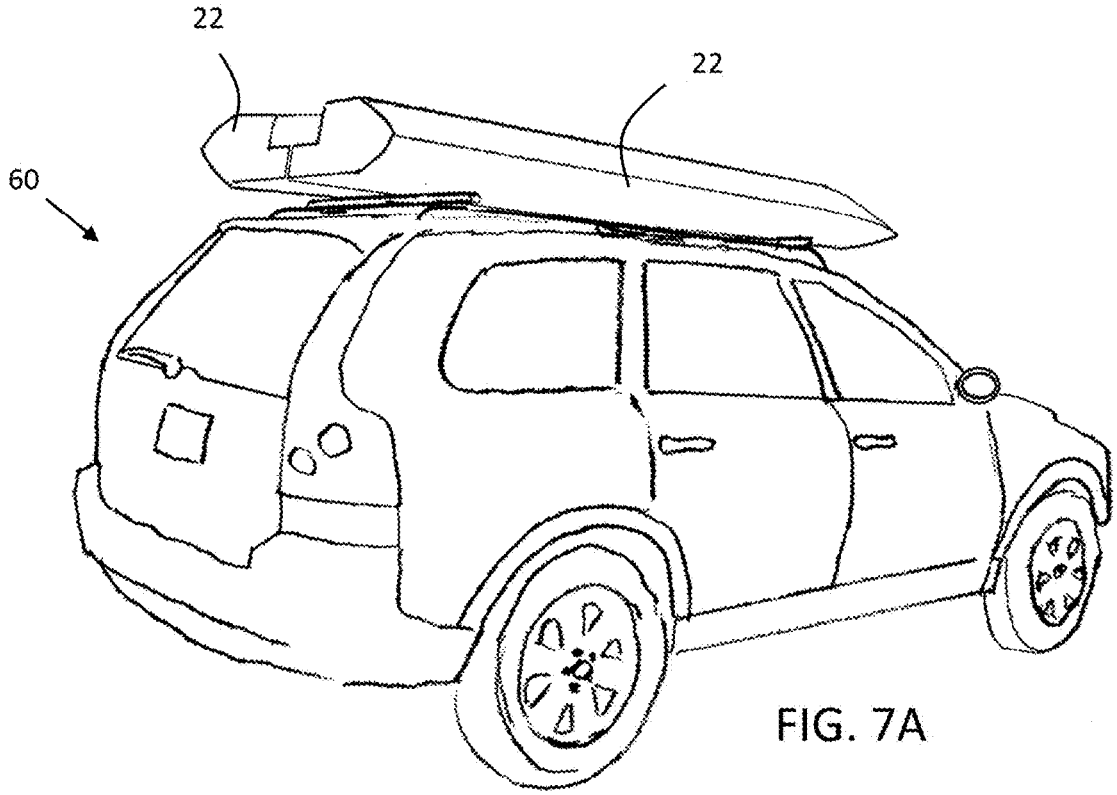
FIG. 7A is a perspective view of a vehicle transporting the modular vessel.
Figure 7B:
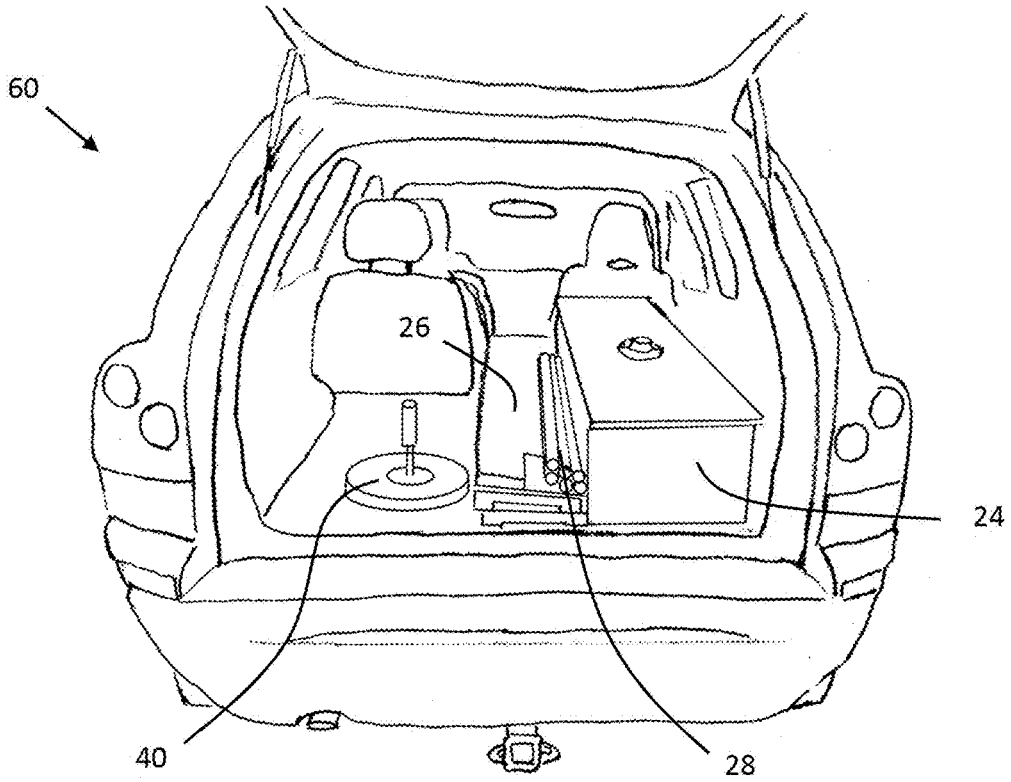
FIG. 7B is a rear view of a modular vessel disassembled and stored within the confines of a vehicle.

FIGS. 7A and 7B illustrate a vessel 20 as disclosed herein disassembled for transportation. As illustrated, a hull 22 of the vessel 20 may be stored along a roof-rack of a vehicle 60 for easy transportation. Additionally, a remaining portion of components of the vessel 20, such as the deck 24, beams 28, seat 40, other components as illustrated in FIGS. 1-7, or a combination thereof may be stored within the confines of the vehicle 60 for transportation. Thus, it is envisioned that the vessel 20 may be easily assembled for operation and may also be quickly disassembled for efficient transportation. It should be noted that FIGS. 7A and 7B are just an example of a configuration for transportation of the vessel 20.

ELEMENT LIST

20 Vessel
22 Hull
24 Deck
26 Plank
28 Beam
28A Oar
30 Groove
32 Compartment
34 Battery
36 Fitting
38 Mount
40 Seat
42 Cleat
44 Oar Lock
46 Reinforcing Material
48 Structural Member
50 Insulating Material
52 Ledge
54 Panel
56 Channel
58 Hole
60 Vehicle Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements, ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

Unless otherwise stated, a teaching with the term "about" or "approximately" in combination with a numerical amount encompasses a teaching of the recited amount, as well as approximations of that recited amount. By way of example, a teaching of "about 100" encompasses a teaching of 100+/−15.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

I claim:

1. A floating vessel comprising:

(a) opposing hulls, wherein each hull includes a ledge that extend inwardly towards one another;

(b) a beam extending between and interconnecting the opposing hulls; and (c) a deck supported by the beam and positioned between the opposing hulls, wherein the deck includes a channel that extends through an entire width of the deck so that the beam extends through the channel to extend between the opposing hulls;

wherein the ledges of the opposing hulls are coplanar with the deck to form a continuous walking surface of the floating vessel.

2. The floating vessel of claim 1, wherein the channel includes an opening along a surface of the deck perpendicular to a top surface of the deck.

3. The floating vessel of claim 2, wherein the floating vessel includes a plank positioned between the deck and the opposing hulls, wherein the plank is supported by the beam and forms additional decking of the vessel that is coplanar with both the deck and the ledges of the opposing hulls.

4. The floating vessel of claim 3, wherein the floating vessel includes a panel extending between the opposing hulls and secured in grooves of the opposing hulls to form a sidewall of the deck.

5. The floating vessel of claim 4, wherein the panel is secured within grooves of the opposing hulls, the grooves being positioned above the ledges of the opposing hulls so that the panel is at least partially supported by the ledges.

6. The floating vessel of claim 1, wherein the vessel includes a plurality of beams and a portion of the plurality of beams forms oars that are movably secured to the vessel.

7. The floating vessel of claim 5, wherein the opposing hulls and the deck each include a compartment configured to house a battery.

8. The floating vessel of claim 7, wherein the battery powers a motor of the vessel, powers lights positioned along the vessel, or both.

9. The floating vessel of claim 1, wherein the deck includes a mount to secure a removable seat of the vessel.

10. The floating vessel of claim 1, wherein the beam is secured within a fitting mounted to a first hull of the opposing hulls and is received by a hole of a second hull of the opposing hulls.

11. The floating vessel of claim 10, wherein the fitting is substantially coaxial with the hole.

12. The floating vessel of claim 11, wherein the fitting secures the beam in place via a fastener.

13. The floating vessel of claim 1, wherein the floating vessel is configured for repetitive assembly and disassembly free of any damage to the floating vessel.

14. The floating vessel of claim 1, wherein the opposing hulls are formed from interconnected structural members and the structural members form a cavity within the opposing hulls.

15. The floating vessel of claim 14, wherein the cavity is filled with an insulating material.

16. The floating vessel of claim 15, wherein the structural members are covered in a reinforcing material.

17. The floating vessel of claim 16, wherein the structural members are wood, and the reinforcing material is fiberglass.

18. The floating vessel of claim 1, wherein the floating vessel is entirely battery operated and is free of any fuel consumption.

19. A modular boat comprising:

(a) a first hull;

(b) a second hull connected to the first hull by a beam extending through a fitting mounted of the first hull and received by a hole of the second hull;

(c) a deck supported by the beam and positioned between the first hull and the second hull, the deck including a channel having an opening along a surface of the deck substantially perpendicular to a top surface of the deck, wherein the beam extends through the channel; and (d) a panel extending between the first hull and the second hull, wherein the panel is inserted into opposing grooves of the first hull and the second hull that extend perpendicular to the top surface of the deck so that the panel forms a sidewall of the deck that also extends perpendicular to the top surface of the deck;

wherein a portion of the first hull, a portion of the second hull, and the panel form sidewalls of the deck that extend perpendicular to the top surface.

20. The floating vessel of claim 1, wherein a portion of the opposing hulls that extends above the ledges form sidewalls of the continuous walking surface.

* * * * *